United States Patent [19]

Burrows

[11] Patent Number: 5,072,590

[45] Date of Patent: Dec. 17, 1991

[54] BOTTLED WATER CHILLING SYSTEM

[75] Inventor: Bruce D. Burrows, Valencia, Calif.

[73] Assignee: Ebtech, Inc., Columbus, Ohio

[21] Appl. No.: 653,054

[22] Filed: Feb. 11, 1991

[51] Int. Cl.[5] ..... F25B 21/02

[52] U.S. Cl. ..... 62/3.64; 366/293; 366/349; 417/313; 62/392

[58] Field of Search ..... 62/3.64, 392; 417/313, 417/426; 366/144, 293, 349

[56] References Cited

U.S. PATENT DOCUMENTS

| | | | |
|---|---|---|---|
| 2,590,007 | 3/1952 | Griswold | 417/313 X |
| 2,931,188 | 4/1960 | Levit | 62/3.64 X |
| 3,323,650 | 6/1967 | Kilbane, Jr. | 366/293 X |
| 3,984,001 | 10/1976 | Nagano et al. | 366/293 X |
| 4,331,017 | 1/1982 | Reed et al. | 62/3.64 |
| 4,537,332 | 8/1985 | Brown et al. | 62/392 X |

*Primary Examiner*—William E. Tapolcai

*Attorney, Agent, or Firm*—Kelly, Bauersfeld & Lowry

[57] ABSTRACT

A chilling system is provided for chilling or cooling a supply of water or the like to a selected low temperature suitable for drinking and other uses. The chilling system includes a thermoelectric heat transfer module having a cold side for extracting heat energy from water contained in a reservoir, and a hot side for transferring the extracted heat energy to a circulating heat transfer fluid. In particular, the hot side of the module is in thermal communication with a manifold block through which a heat transfer fluid such as water is circulated by a pump. The pump circulates the heat transfer fluid through a heat exchanger for dissipating the extracted heat energy. In addition, the same pump drives an impeller within the reservoir to maintain the reservoir contents at a substantially uniform temperature level, and further may drive a cooling fan for providing a convective air flow across the heat exchanger.

11 Claims, 2 Drawing Sheets

BOTTLED WATER CHILLING SYSTEM

BACKGROUND OF THE INVENTION

This invention relates generally to improvements in devices and systems for cooling a supply of water used for drinking, cooking, etc. More specifically, this invention relates to a compact chilling system for efficiently and quietly chilling a supply of water, particularly in a bottled water dispenser station or the like.

Bottled water dispenser stations are well known in the art for containing a supply of relatively purified water in a convenient manner and location ready for substantially immediate dispensing and use. Such water dispenser stations commonly include an upwardly open reservoir adapted to receive and support a water bottle of typically three to five gallon capacity in an inverted orientation such that bottled water may flow downwardly into the dispenser reservoir. A spigot on the front of a station housing is operable at any time to dispense the water in selected amounts. Such bottled water stations are widely used to provide a clean and safe source of drinking water, especially in areas wherein the local water supply may or is suspected to contain undesired levels of contaminants.

In many bottled water dispenser stations, it is desirable to refrigerate the water within the station reservoir to a relatively low temperature to provide a highly pleasing and refreshing source of drinking water. However, refrigeration equipment for such dispenser stations has normally included conventional mechanical refrigeration apparatus which undesirably increases the overall cost, complexity, size, operational noise level, and power consumption requirements of the water dispenser station. Alternative cooling system proposals have suggested the use of relatively compact thermoelectric heat transfer cooling modules, but these proposals have generally required heat dissipation sinks of relatively large surface area and/or large and noisy cooling fans to obtain adequate transfer of thermal energy from water within the station reservoir. The use of large heat sinks and/or large cooling fans in dispenser stations of the this type has undesirably created significant size and noise problems together with undesirable increases in system operating cost. Attempts to improve heat transfer efficiency in such thermoelectric systems have included circulation of drain water as a heat transfer fluid, but such systems require inconvenient plumbing connections and further do not operate satisfactorily when drain water flow is not present.

There exists, therefore, a significant need for further improvements in thermoelectric chilling systems of the type adapted for use in bottled water dispenser stations and the like, particularly with respect to a compact and operationally efficient system which avoids the need for drain plumbing connections, large heat sinks, or large cooling fans. The present invention fulfills these needs and provides further related advantages.

SUMMARY OF THE INVENTION

In accordance with the invention, an improved water chilling system is provided for cooling a water supply to a selected low temperature level for use in drinking, cooking etc. The chilling system is particularly adapted for use with a bottled water dispenser station or the like of the type having a reservoir for receiving and storing a supply of water ready for dispensing and use. A thermoelectric heat transfer module is mounted in thermal communication with the reservoir to extract thermal energy from water within the reservoir, and to transfer the extracted heat energy to a circulating fluid for dissipation via a compact heat exchanger.

In the preferred system arrangement of the present invention, the thermoelectric heat transfer module has a cold side mounted in heat exchange relation with the water supply contained within the storage reservoir. The module is adapted for connection to suitable power source, preferably a standard domestic ac power supply via rectified power supply. The thermoelectric module operates to draw or extract thermal energy from the water supply, and to transfer that energy to a hot side of the module. The module hot side is positioned in a manifold block in heat exchange relation with a circulating heat transfer fluid such as water. A small pump including a drive motor for driving a pump impeller circulates the heat transfer fluid through a closed loop path including the manifold block. The closed loop path further includes the compact heat exchanger, such as a finned tube dissipation device, for dissipating the extracted heat energy. In addition, the pump drive motor drives a reservoir impeller disposed within the reservoir to circulate the reservoir contents in a manner maintaining substantially uniform chilled temperature level. The preferred arrangement further includes a small fan which is also driven by the pump drive motor to provide a convective air flow across the heat exchanger.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
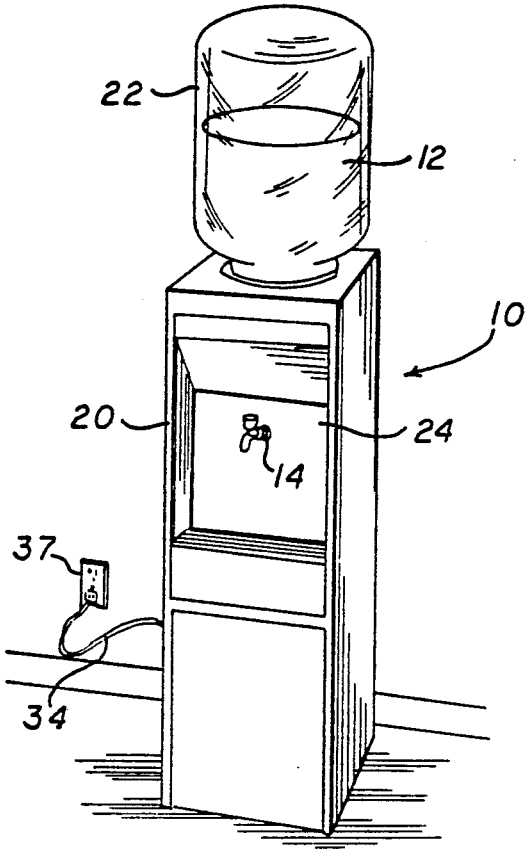
FIG. 1 is a perspective view illustrating a bottled water dispenser station adapted for use with the water chilling system embodying the novel features of the invention.
Figure 2:
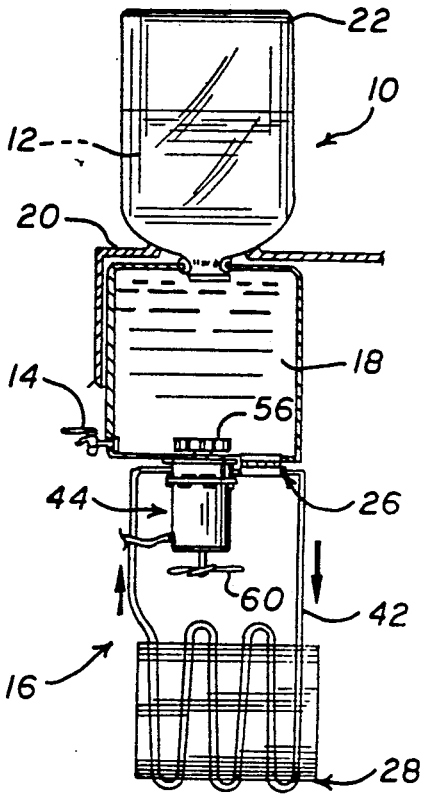
FIG. 2 is a somewhat schematic diagram illustrating the bottled water dispenser station in combination with the water chilling system of the present invention.

As shown in the exemplary drawings, a bottled water dispenser station referred to generally in FIGS. 1 and 2 by the reference numeral 10 is adapted to contain and store a supply of water 12 for substantially immediate dispensing and use by operation of a spigot 14. The dispenser station 10 includes an improved chilling system 16 (FIG. 2) constructed in accordance with the present invention, wherein the chilling system provides a relatively inexpensive, compact, energy-efficient and quiet-running system for chilling the water supply 12 to a pleasing, refreshing temperature.

The illustrative dispenser station 10 has a generally conventional construction to include an upwardly open reservoir 18 supported by an upright station housing 20. The water reservoir 18 is adapted to receive and support a water bottle 22 in an inverted orientation, such that water 12 within the bottle 22 is free to flow downwardly into the station reservoir 18. The spigot 14 is typically mounted in an accessible position on a front panel 24 of the station housing 20, and is manually operable for gravity dispensing of water within the reservoir 18. In accordance with the present invention, the bottled water dispenser station 10 is equipped with the improved chilling system 16 for refrigerating the water supply 12, thereby providing a highly pleasing and refreshing source of water for drinking and other purposes. The chilling system 16 includes a small number of components and may be constructed in a compact geometry, while providing substantial cooling capacity. Importantly, the chilling system 16 of the present invention does not require large heat sinks to achieve the desired cooling capacity.

Figure 3:
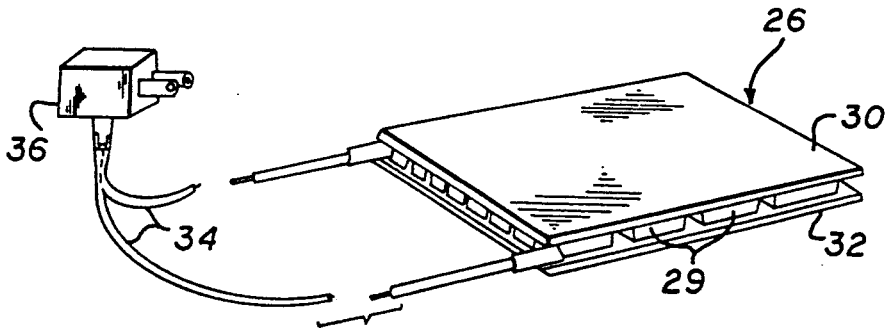
FIG. 3 is an enlarged perspective view illustrating a thermoelectric heat transfer module for use in the chilling system
Figure 4:
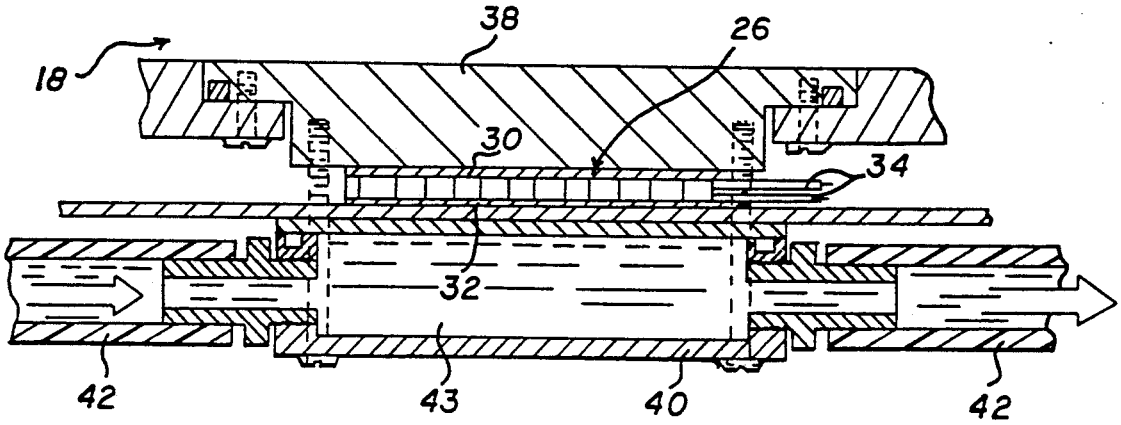
FIG. 4 is an enlarged fragmented vertical sectional view depicting installation of the thermoelectric heat transfer module in the chilling system.

As shown in FIGS. 2–4, the improved water chilling system 16 of the present invention utilizes a thermoelectric heat transfer module 26, such as a module manufactured by Borg-Warner Corporation under the Model Number 920-31 and employing semi-conductor materials with dissimilar characteristics (P-type and N-type materials) connected electrically in series and thermally in parallel. The module 26 operates to draw or extract thermal energy from the water supply 12 within the reservoir 18, and to transfer the extracted heat energy to a circulating heat transfer fluid. The heat transfer fluid in turn carries the extracted heat energy to a compact heat exchanger 28 for efficient dissipation.

More specifically, as shown best in FIGS. 3 and 4, the thermoelectric module 26 comprises a plurality of semiconductor devices 29 sandwiched between upper and lower heat transfer substrates 30 and 32, respectively. Electrical conductors 34 are appropriately connected to the semi-conductor devices 29 and extend from the module 26 for connection to an appropriate source of electrical power. In the preferred form of the invention as shown in FIGS. 1 and 3, the conductors 34 are connected to a conventional rectified power supply 36 adapted for plug-in connection to a conventional household ac power supply 37. In operation, the upper substrate 30 comprises a cold side of the module for extracting heat energy which is transferred to the lower substrate 32 thereby providing a module hot side.

The thermoelectric heat transfer module 26 is mounted in sandwiched relation between a heat transfer plate 38 at the bottom of the reservoir 18, and a manifold block 40 through which the heat transfer fluid is circulated. More particularly, appropriate mounting screws may be provided for securely sandwiching the module 26 between the heat that module operation causes heat energy to flow from the water supply 12 within the reservoir 18 to the manifold block 40.

The manifold block 40 is connected in-line with a closed loop circulation network 42 of tubing, wherein this network 42 is substantially filled with a selected heat transfer fluid 43, such as water. A pump 44 mounted along the network 42 and circulates the heat transfer fluid in a relatively low flow manner when the pump is on. This circulation causes the fluid to flow through the manifold block 40, such that heat extracted from the water supply is transferred to the circulating fluid at relatively high efficiency. From the manifold block 40, the heat transfer fluid passes further through the tubing 42 and the heat exchanger 28, such as elongated finned tubing as depicted in FIG. 2.

Figure 5:
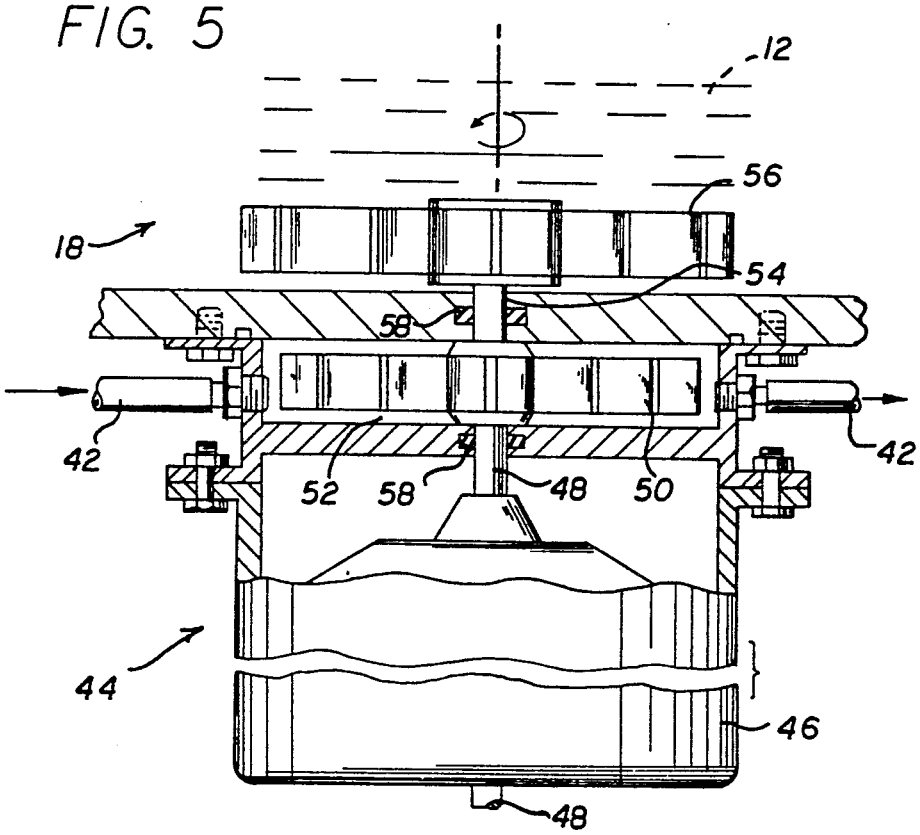
FIG. 5 is an enlarged fragmented vertical sectional view illustrating construction and mounting details of a pump for use in the chilling system.

The preferred construction and mounting arrangement for the pump 44 is shown in detail in FIG. 5. As shown, the pump 44 comprises a small electric motor 46 having a single drive shaft 48 providing a rotational output motion. The drive shaft 48 extends from the motor 46 and carries a pump impeller 50 mounted within a pump chamber 52 disposed inline with the tubing 42 at the bottom of the reservoir 18. The shaft 48 rotatably drives the pump impeller 50 to circulate the heat transfer fluid 43 through the closed loop network, as previously described. In addition, the pump drive shaft 48 extends further through a port 54 at the bottom of the reservoir whereat a reservoir impeller 56 is mounted on the shaft 48 for concurrent rotational operation to stir and mix the reservoir water in a manner maintaining a substantial uniform chilled temperature distribution throughout. Appropriate shaft seals 58 are provided to seal passages of the drive shaft 48 into and from the pump chamber 50.

In addition, in the preferred arrangement, the drive shaft 48 projects from the motor 46 in a direction opposite to the reservoir and carries a small fan 60 (FIG. 2) for creating a convective air flow which assists in cooling the motor 46. This connective air flow is further directed to flow across the heat exchanger 28, whereby the air flow additionally assists in heat extraction from the closed loop network.

Accordingly, the present invention provides relatively simple yet efficient chilling arrangement for maintaining a water supply 12 at a bottled water station 10 or the like at a pleasing and refreshing low temperature level. Alternately, it will be understood that the closed looped chilling system of the present invention may be used for chilling other types of water supplies, such as purified water in a reverse osmosis purification system of the type disclosed, for example, in U.S. Pat. No. 4,752,389.

A variety of modifications and improvements to the invention described herein will be apparent to those skilled in the art. For example, appropriate thermal controls may be added to regulate operation of the module 26 in response to the temperature of the water supply 12 to prevent overchilling. Moreover, if desired, the drive shaft 48 can be hermetically connected to the impellers 50 and 56 by means of magnetic couplings, if desired. Accordingly, no limitation on the invention is intended by way of the foregoing description and accompanying drawings, except as set forth in the appended claims.

What is claimed is:

1. A water chilling system for chilling a supply of water within a storage reservoir of a bottled water dispenser station or the like, said system comprising:

a thermoelectric heat transfer module having a hot side and cold side, and means for transferring thermal energy from said cold side to said hot side;

means for mounting said module with said cold side in thermal communication with the water supply within the storage reservoir;

a heat exchanger;

a closed loop circulation network connected between said heat exchanger and said module hot side;

a heat transfer fluid within said circulation network; and pump means for circulating the heat transfer fluid through said closed loop circulation network, said pump means including a drive motor having a drive shaft, a first impeller driven by said drive shaft for circulating the heat transfer fluid through said circulation network, and a second impeller driven by said drive shaft for stirring water within the reservoir.

2. The water chilling system of claim 1 wherein the heat transfer fluid is water.

3. The water chilling system of claim 1 further including a manifold block mounted along said closed loop network in heat transfer relation with said module hot side.

4. The water chilling system of claim 1 wherein said heat exchanger comprises a finned tube heat exchanger.

5. The water chilling system of claim 1 further including an air flow fan driven by said drive shaft and positioned to provide an air flow across said heat exchanger.

6. A water dispenser station, comprising:

a housing defining a storage reservoir adapted to receive a supply of water;

a thermoelectric heat transfer module having a hot side and cold side, and means for transferring thermal energy from said cold side to said hot side;

means for mounting said module with said cold side in thermal communication with the water supply within the storage reservoir;

a heat exchanger;

a closed loop circulation network connected between said heat exchanger and module hot side;

a heat transfer fluid within said circulation network; and pump means for circulating the heat transfer fluid through said closed loop circulation network, said pump means including a drive motor having a drive shaft, a first impeller driven by said drive shaft for circulating the heat transfer fluid through said circulation network, and a second impeller driven by said drive shaft for stirring water within the reservoir.

7. The water dispenser station of claim 6 wherein the heat transfer fluid is water.

8. The water dispenser station of claim 6 further including a manifold block mounted along said closed loop network in heat transfer relation with said module hot side.

9. The water dispenser station of claim 6 wherein said heat exchanger comprises a finned tube heat exchanger.

10. The water dispenser station of claim 6 further including an air flow fan driven by said drive shaft and positioned to provide an air flow across said heat exchanger.

11. The water dispenser station of claim 6 further including a heat transfer element mounted on said reservoir in thermal communication between the water supply and said module cold side.

* * * * *